United States Patent [19]

Sekiguchi et al.

[11] 3,975,486

[45] Aug. 17, 1976

[54] PROCESS FOR PRODUCING ANTI-PILLING ACRYLIC FIBER

[75] Inventors: Hideto Sekiguchi; Masao Sone; Mitsunori Sato, all of Okayama, Japan

[73] Assignee: Japan Exlan Company Limited, Osaka, Japan

[22] Filed: Sept. 13, 1973

[21] Appl. No.: 396,777

[30] Foreign Application Priority Data

Sept. 14, 1972 Japan ..... 47-92343

[52] U.S. Cl. ..... 264/182; 264/210 F

[51] Int. Cl.[2] ..... D01F 6/18

[58] Field of Search ..... 264/181, 182, 210 F

[56] References Cited

UNITED STATES PATENTS

| | | | |
|---|---|---|---|
| 3,412,191 | 11/1968 | Kitajima et al. | 264/181 |
| 3,463,846 | 8/1969 | Nakagawa et al. | 264/182 |
| 3,485,913 | 12/1969 | Yamado et al. | 264/210 F |
| 3,523,150 | 8/1970 | Vigneault | 264/182 |
| 3,562,378 | 2/1971 | Fujita et al. | 264/182 |
| 3,621,087 | 11/1971 | Shimamura et al. | 264/182 |
| 3,676,540 | 7/1972 | Storg et al. | 264/182 |
| 3,706,828 | 12/1972 | Tzentis | 264/182 |
| 3,801,691 | 4/1974 | Brigmanis et al. | 264/182 |
| 3,812,004 | 5/1974 | Chinai et al. | 264/182 |
| 3,851,036 | 11/1974 | Tzentis | 264/182 |
| 3,885,013 | 5/1975 | Sato | 264/182 |

*Primary Examiner*—Jay H. Woo

*Attorney, Agent, or Firm*—Wenderoth, Lind & Ponack

[57] ABSTRACT

The present invention relates to a process for producing an anti-pilling acrylic fiber which has excellent level dyeing properties. This process involves dissolving an acrylonitrile in an inorganic solvent to prepare a spinning solution, wherein the inorganic solvent in the spinning solution is 40–70%, subjecting the spinning solution to wet-spinning by extrusion through spinneret orifices into a coagulation bath containing an inorganic solvent in an amount of 50–70% of that in the spinning solution, while maintaining the linear velocity ratio of free extrusion at 1 or higher and the jet stretch ratio 1.5 or higher, stretching the formed gel fibers 3–7 times the length in hot water or in a heated steam medium at 80°–120°C, drying the stretched fibers and then subjecting the fibers to a relaxation treatment in a hot air current at a temperature of 150°C or lower or in a wet heat atmosphere at a temperature of 120°C or lower. The jet stretch ratio is defined as being the quotient obtained by dividing the takeup speed of the coagulated filaments from the coagulation step by the linear velocity of extrusion of the spinning solution through the spinneret orifices.

3 Claims, 2 Drawing Figures

PROCESS FOR PRODUCING ANTI-PILLING ACRYLIC FIBER

Figure 1:
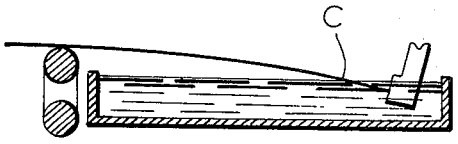

The present invention relates to a process for producing a new anti-pilling acrylic fiber, and more particularly to a process for producing an acrylic fiber excellent in level dyeing and anti-pilling qualities, wherein the steps of coagulation, stretching and relaxing heat treatment are conducted under particular conditions.

It is well known that acrylic fibers have a wool-like soft touch and good dyeability and find a wide field of use in textile materials as well as interior decoration materials.

However, it is not that acrylic fibers of such great usefulness are entirely free from defects in practical use, so that in certain fields of use, rapid establishment of industrial means for improving fiber qualities has been demanded.

Although the anti-abrasion and anti-fibrillation of acrylic fibers almost satisfy the practical level required for textile materials, woven and knitted fabrics produced from acrylic fibers generate so-called pills, i.e. small balls of interlaced fluff, on the surface of the fabrics with the lapse of time and wear, which is a shortcoming that lowers the commercial value of the fabrics.

Such generation of pills is not a problem peculiar to only acrylic fibers but is a defect in practical use widely observed in polyamide fibers and polyester fibers. Even though it may be said that the generation of pills in woven or knitted fabrics produced from acrylic fibers is rather little in comparison with polyamide fibers or polyester fibers, it is still fairly remarkable in comparison with the fabrics obtained from wool fiber. It is because of this that acrylic fibers have not been substituted for wool as materials for woven or knitted products.

However, there have been proposed several industrial means for preventing such generation of pills. For example, Japanese Patent Publication No. 5863/1963 described that the anti-pilling quality of acrylic fibers can be grasped as a correlation with the single filament denier and strength characteristic, and Japanese Patent Publication No. 18195/1964 describes imparting of anti-pilling quality to fabrics of acrylic fibers by treating the fabrics with an aqueous solution of aniline, aniline acetate, aniline hydrochloride, or aniline sulfate.

In practice, however, the single filament denier in the former method is required to be fairly large, and therefore such acrylic fiber finds no substantial utilization in the field of general textile material, though as carpet material there may be a certain degree of usefulness. For the latter method, it is essentially questionable whether such fiber can be used in practice from viewpoint of its odor and colouring.

Recently, Japanese Patent Publication Nos. 37009/1971 and 8189/1972 propose processes for producing anti-pilling acrylic fibers. These processes, however, have several problems to be solved. In the former method, on account of the mixing of polymers of low degree of polymerization, there takes place such disadvantages as low productivity in the polymerization step, and non-uniformity of mixing. In the latter method, its practice on an industrial scale is still a problem in viewpoint of the price of methacrylonitrile monomer used as a copolymerization component, and the dyeability of the final fiber.

On the contrary, it is well known that acrylic fibers have good dyeability in a general sense. However, rather complex dyeing recipes and a large amount of retarders and a long time of dyeing required for acrylic fibers have hindered high speed dyeing and labor saving markedly.

Explained in more detail, for an improved even dyeability of acrylic fibers, the fibers desirably possess a sufficient amount of dye sites for deep dyeing or black dyeing and a moderate dyeing speed useful in the rapid dyeing process. However, since these two characteristics are of essentially opposite nature, it has been extremely difficult to satisfy both at the same time in conventional processes for producing acrylic fibers, especially in the process of producing acrylic fibers by wet spinning process.

We have made an intensive study to remove the abovementioned restrictions occurring with conventional acrylic fibers or with the process for producing the same and to produce acrylic fibers of excellent anti-pilling and level dyeing qualities. As a result, we have found that when the later-mentioned linear velocity ratio of a free extrusion, jet stretch ratio and stretch ratio of gel swollen fiber as well as the relaxing heat treatment temperature are maintained in a specific range the objects of the present invention can be effectively attained.

One of the main objects of the present invention is to provide a new acrylic fiber which is improved in both anti-pilling and level dyeing qualities at the same time.

Another main object of the present invention is to establish an industrially easily practicable process for producing acrylic fibers wherein the linear velocity ratio of a free extrusion, jet stretch ratio and stretch ratio of gel swollen fiber as well as relaxing heat treatment temperature are maintained in a specific range.

Further objects of the present invention will become apparent from the following description.

The foregoing objects of the present invention can be effectively attained by the provision of a new process for producing acrylic fibers wherein a spinning solution prepared by dissolving an acrylonitrile polymer in an inorganic solvent is wet-spun through spinneret orifices, with the linear velocity ratio of a free extrusion maintained above 1 and the jet stretch ratio above 1.5, and the thus-obtained gel swollen fiber is stretched 3 to 7 times the initial length, dried and then subjected to relaxing heat treatment in a hot air current lower than 150°C, preferably between 130°C and 150°C, or in a wet heat atmosphere below 120°C, preferably between 100°C and 120°C.

Prior to going into detailed explanations of the process of the present invention, some explanations on the linear velocity ratio of a free extrusion defined in the present invention are given in the following.

Figure 2:
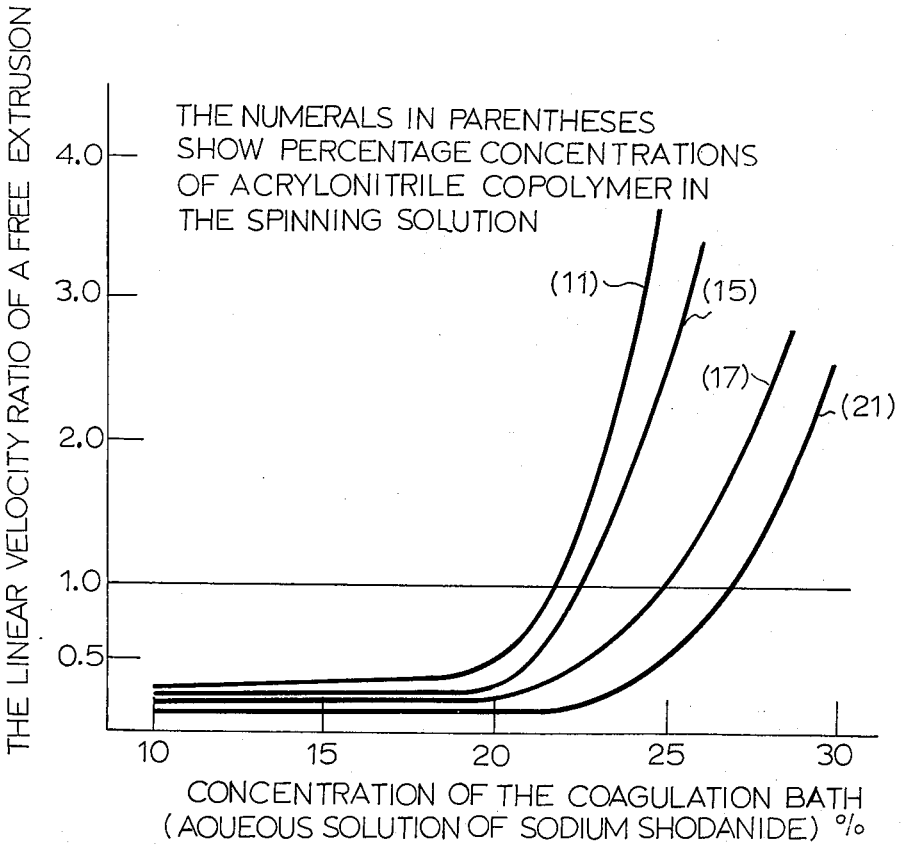

FIG. 1 is an example of a horizontal type coagulation bath for measuring linear velocity ratio of the free extrusion, and FIG. 2 is an orthogonal coordinate diagram exemplifying the relation between linear velocity ratio of the free extrusion and coagulating bath composition.

In known wet spinning processes, the coagulation medium for the spinning solution (dope) extruded through spinneret orifices is a liquid. Thus, to facilitate the circulation of coagulation bath and the takeup of the coagulated filaments, it has been common practice to use a horizontal type coagulation bath as shown in FIG. 1. The spinning solution (dope) extruded through the spinneret orifices travels nearly horizontal through the coagulation bath while being removed from the solvent and the resulting filaments are withdrawn from the coagulation bath.

In the coagulation step of fiber-forming polymer by such wet spinning process, we observed the behavior of fiber formation by varying the takeup speed of the coagulated filaments, while maintaining the linear velocity of extrusion of the spinning solution through the spinneret orifices constant. As a result, we have found that the desolvation behavior of gel swollen filaments travelling through the coagulation bath can be quantitatively grasped as a variation of the takeup tension of the swollen gel filaments, and that the takeup tension is predominantly affected by the concentration of the fiber-forming polymer in the spinning solution to form the coagulated filaments and by the composition of the coagulation bath.

More precisely explaining, when only the takeup speed of the coagulated filaments is increased, with the linear velocity of the spinning solution through the spinneret orifices maintained constant, the takeup tension of the coagulated filaments will gradually increase to break the filaments finally. On the contrary, according as the takeup speed is decreased, the tension of the coagulated filaments decreases to reach a relaxed condition substantially free from the influence of external force except the weight itself of the coagulated filaments. Such variation of the takeup tension of the coagulated filaments is influenced by the desolvation behavior of the spinning solution extruded into the coagulation bath through the spinneret orifices. However, essentially, the desolvation behavior is more greatly influenced by the concentration of the fiber-forming polymer in the spinning solution as well as the composition of the coagulation bath. In the former case, that is, in the behavior of breaking the coagulated filaments under tension, the takeup speed upon breaking of the coagulated filaments is usually called maximum takeup speed, and the quotient obtained by dividing the maximum takeup speed by a linear velocity of an extrusion of the spinning solution from the spinneret orifices is defined as maximum jet stretch ratio, which is used as a physical quantity to evaluate the spinnability. However, usually in the industrial scale practice, spinnerets having a large number of orifices are used. Thus, it is rather unusual that the coagulated filaments will be broken uniformly at one time as a whole filament bundle by increased takeup tension. Accordingly, it is quite impractical to use the maximum jet stretch ratio measured on a single coagulated filament as a physical quantity expressing the spinnability or filament-forming characteristics of the extruded fiber bundle. Such tendency of coagulation behavior is particularly noticed when the coagulation ability of the coagulation bath is small for the extruded spinning solution, that is, when the coagulation rate of the swollen gel fibers in the coagulation bath is slow. Also, we made a detailed study on the latter case, that is, on the desolvation behavior and fiber-forming behavior of the extruded filaments in a relaxed condition in which the takeup speed of the coagulated filaments is decreased to reduce the takeup tension of the filaments. As a result, we noticed that the takeup speed in a condition in which the coagulated filaments are given the lowest possible takeup tension sufficient to maintain a tensioned state between the spinneret orifices and the drawing rollers from the coagulation bath, has a special significance as a physical quantity expressing the free extrusion state of the spinning solution, in which there is no practical influence of external force on the coagulated filaments except the weight itself of the filaments. We call such extrusion velocity of the spinning solution as a linear velocity of a free extrusion and the quotient obtained by dividing the linear velocity of a free extrusion by the extrusion velocity of the spinning solution through the spinneret orifices is defined as the linear velocity ratio of a free extrusion. By the use of the linear velocity ratio of a free extrusion in combination with the foregoing jet stretch ratio, it has become possible to solve the fiber-forming behavior as well as desolvation behavior of the coagulated filaments in the coagulated step more clearly.

In a more detailed explanation, linear velocity ratio of a free extrusion is not only useful as a practical measure for evaluating the spinnability but has a physicochemical significance as a measure for quantitatively expressing the volumetric diminution rate due to desolvation of the swollen gel filaments in the coagulation bath. Namely, in the case of a large desolvation rate, the volumetric diminution tendency of the extruded swollen gel filaments is large, so that the linear velocity ratio of a free extrusion becomes reduced. On the contrary, when the desolvation rate is small, the volumetric diminution rate of the swollen gel filaments in the coagulation step becomes reduced to inccrease the linear velocity ratio of a free extrusion.

By measuring the linear velocity ratio of a free extrusion while varying the concentration of the fiber-forming polymer contained in the spinning solution as well as the composition of the coagulation bath, we quantitatively elucidated the desolvation behavior and fiber forming behavior, the elucidation of which is effective for the improvement of anti-pilling and level dyeing qualities of the fiber. Thus, we attained the present invention.

In a more concrete explanation, while varying the concentration of the fiber-forming polymer in the spinning solution and the composition of the coagulation bath, the coagulated filaments are made to travel in a straight line between the spinneret orifices and the drawing rollers under the takeup tension, as shown in FIG. 1. In such a condition, obtain the leaving point C of the coagulated filaments from the coagulation bath surface into an inert medium such as air. Then, reduce the takeup speed gradually so that the coagulated filaments are suspended in a relaxed condition between the spinneret orifices and the drawing rollers, and observe the movement of the leaving point C. Namely, with the decrease of the takeup tension, the leaving point C of the coagulated filaments from the coagulation bath surface moves gradually toward the drawing roller side. Now, hold the coagulated filaments straight in a tensioned state between the spinneret orifices and the drawing rollers. Then, while reducing the takeup speed, at the moment when a movement of the leaving the point C takes place, that is, the takeup speed at the very moment of moving from a tensioned state to a relaxed state. This takeup speed is taken as the linear velocity of a free extrusion.

In the production of acrylic fibers, FIG. 2 shows an example of the relation between the linear velocity ratio of a free extrusion and coagulation bath composition, as observed with varying concentrations of the fiber-forming polymer in the spinning solution, in the case of using a horizontal coagulation bath in which the immersion length of the coagulated filaments is 300 mm and the temperature is maintained at −3°C.

As a result of repeating a series of systematic experiments on the basis of the abovementioned knowledge, we have found that the anti-pilling and level dyeing quality of acrylic fibers can be markedly improved by maintaining the linear velocity ratio of a free extrusion as well as the stretch ratio of swollen gel fiber at a low ratio and the relaxing heat treatment temperature at a low temperature in comparison with the conventional general temperature condition.

In the practice of the present invention, to maintain the linear velocity ratio of a free extrusion within the range above 1, the concentration of the inorganic solvent used in the coagulation bath is desirably adjusted to the range of 50 to 70% of the concentration of the inorganic solvent used for dissolving the acrylonitrile polymer in preparing the spinning solution.

Desirably, such concentration of the inorganic solvent used in preparing the spinning solution in the present invention is in the range of 40 to 70%.

In the case that the composition of the coagulation bath goes out of the foregoing preferred range, it is practically impossible to maintain the spinning solution of acrylonitrile polymer extruded through the spinneret orifices at the linear velocity ratio of a free extrusion above 1 and it becomes also difficult to maintain a jet stretch ratio above 1.5 which, together with the foregoing linear velocity ratio of a free extrusion, is effective for the improvement of anti-pilling and level dyeing qualities and effective for obtaining a moderate dye absorption rate.

In the range in which the jet stretch ratio is less than 1.5, the gel filaments extruded into the coagulation bath become excessively sagged and consequently wind around the drawing rollers on being drawn from the coagulation bath and thus the spinnability becomes seriously lowered. Moreover, in the case of using a jet stretch ratio of less than 1.5, however the process conditions in the subsequent 3 ~ 7 times stretching step, drying step or relaxing heat treatment step may be regulated, it becomes difficult to impart to the extruded fiber a degree of orientation necessary for the improvement of stress-strain property and therefore the stress-strain property of the final products which is a secondary effect of the present invention is greatly lowered. Accordingly, in order to maintain the dyeing and stress-strain property in a range satisfactory for practical use and yet with an improvement of the anti-pilling quality, it is necessary to give the linear velocity ratio of a free extrusion above 1 and a jet stretch ratio above 1.5 to the spinning solution at the same time in the coagulation step.

As another embodiment of the present invention, the following two-stage coagulation process can be carried out without departing from the claims of the invention so far as the first bath satisfies the foregoing preferred range of linear velocity ratio of a free extrusion and jet stretch ratio. Namely, after the first-stage coagulation step satisfying the abovementioned linear velocity ratio of a free extrusion and jet stretch ratio, the coagulated filaments are further introduced into a second-stage coagulation bath having a solvent concentration of 20 to 30% based on the concentration of the inorganic solvent used for the preparation of the spinning solution.

When the stretch ratio given to the swollen gel fiber before drying is less than 3, the linear velocity of takeup from the coagulation bath is greatly increased, so that the coagulation bath flies about, or filament breaking takes place frequently because the single filament denier of the unstretched swollen gel fiber is made extremely fine. Such disadvantages interrupt stable spinning. On the contrary, in the region where the stretch ratio of the swollen gel fiber before drying is in excess of 7, the degree of orientation of the extruded fiber is increased excessively, so that the finally obtained acrylic fiber cannot maintain the strength level effective for the improvement of anti-pilling quality.

In the present invention, the 3 ~ 7 times stretching for the swollen gel fiber before drying means a stretching in hot water or in a heated steam medium at 80° to 120°C, and can be carried out irrespective of the spinning speed and single filament denier so far as the linear velocity ratio of a free extrusion and the jet stretch ratio are maintained within the abovementiond preferred ranges.

The swollen gel fiber that has passed through the foregoing stretching step is thereafter dried to compact the fiber structure and then further subjected to relaxing heat treatment in a hot air current or in a wet heat atmosphere. This relaxing heat treatment is carried out at a low temperature in comparison with the conventional relaxing heat treatment condition for acrylic fibers, that is, in a hot air current below 150°C or in a wet heat atmosphere below 120°C, preferably for less than 15 minutes. By the use of such a peculiar relaxing heat treatment condition, it is possible to impart to the final fiber a shrinking ratio below 12% which is effective for the improvement of the anti-pilling quality as well as the level dyeing quality due to the decrease of dye absorption rate.

The shrinking imparted to the final fiber in the present invention means a heat shrinkability imparted to the acrylic fiber by relaxing heat treatment after the drying step in dry or wet atmosphere, and more concretely it is the quotient obtained by dividing the value of the fiber length after drying minus the fiber length after relaxing heat treatment by the fiber length after drying.

The expression "acrylic fibers" as referred to in the present invention is a generic term for the fibers composed of an acrylonitrile polymer containing at least 80% by weight of combined acrylonitrile. Representative compounds which may be copolymerized with acrylonitrile to form acrylonitrile polymers useful for the practice of the present invention are compounds containing a single $CH_2=C<$ group, for instance vinyl esters especially the vinyl esters of unsaturated aliphatic monocarboxylic acids, e.g. vinyl acetate, vinyl propionate, vinyl butyrate, etc.; vinyl halides and vinylidene halides, e.g. vinyl chloride, vinyl bromide, vinyl fluoride, vinylidene chloride, vinylidene bromide, vinylidene fluoride, etc.; allyl-type alcohols, e.g. allyl alcohol, methallyl alcohol, ethallyl alcohol, etc.; allyl, methallyl and other unsaturated monohydric alcohol esters of monobasic acids, e.g. allyl and methyallyl acetates, laurates, cyanides, etc.; acrylic and alkacrylic acids (e.g. methacrylic, ethacrylic, etc.) and esters and amides of such acids (e.g. methyl, ethyl, propyl, butyl, etc. acrylates and methacrylates, acrylamide, methacrylamide, N-methyl, -ethyl, -propyl, -butyl, etc. acrylamides and methacrylamides, etc.); methacrylonitrile, ethacrylonitrile, and other hydrocarbon-substituted acrylonitriles; unsaturated sulfonic acids containing a single $CH_2=C<$ group and their salts, e.g. allylsulfonic acid, methallylsulfonic acid, styrene sulfonic acid, and their sodium and potassium salts; unsaturated aliphatic hydrocarbons containing a single $CH_2=C<$ goup, e.g. isobutylene; and numerous other vinyl, acrylic and other compounds containing a single $CH_2=C<$ group which are copolymerizable with acrylonitrile to yield thermoplastic copolymers. Alkyl esters of alpha, beta-unsaturated polycarboxylic acids may also be copolymerized with acrylonitrile to form copolymers, e.g. dimethyl, -ethyl, -propyl, -butyl, etc. esters of maleic, fumaric, citraconic, etc. acids.

Among the inorganic solvents which may be used in the present invention may be mentioned: rhodanides e.g. sodium rhodanide, potassium rhodanide, ammonium rhodanide and calcium rhodanide and mixtures of these rhodanides; concentrated aqueous solutions of inorganic salts, e.g. zinc chloride, lithium chloride, etc.; and concentrated aqueous solutions of inorganic acids, e.g. sulfuric acid, nitric acid, etc.

As apparent from the foregoing explanation, the coagulation bath may be a same aqueous inorganic solvent solution as used for the preparation of the spinning solution, however in concentration of 50 to 70% with respect to the concentration of the inorganic solvent in the spinning solution.

In the practice of the present invention, for the drying treatment condition of the acrylic fiber stretched in a swollen gel state, any known method can be used. However, when acrylic fibers are subjected to the drying and structure collapsing process under specified temperature-humidity conditions mentioned in Japanese Patent Publication No. 8476/1967, the acrylic fibers become more compact in structure, and by the combined use of the abovementioned coagulation step and stretching step, not only anti-pilling and level dyeing qualities but also, as other effects, optical characteristics, e.g. brightness, Young's modulus in hot water, ability for forming non-circular filament cross section, antifibrillation can be remarkably improved.

For the sake of convenience, the explanation of the linear velocity ratio of a free extrusion in the previous paragraphs has been made on the filament formation using a horizonal type coagulation bath. However, once the inorganic solvent compositions of the spinning solution and coagulation bath which are able to maintain the linear velocity ratio of a free extrusion above 1 are obtained, any coagulation bath other than horizontal bath may be used to attain the action and effect of the present invention effectively.

Thus, by the combination of the abovementioned peculiar coagulation step, stretching step in a swollen gel state of the fiber and the relaxing treatment step, the process of the present invention improves the anti-pilling and level dyeing qualities of acrylic fibers remarkably and yet maintaining the stress-strain property of the fiber at a level for practical use, and therefore in its industrial practice it contributes greatly to the industry. Moreover, the acrylic fiber produced according to the present invention is improved in anti-fibrillation, Young's modulus in hot water, brightness, ability in the formation of non-circular cross section figer, etc. as other effects. Therefore, also in this respect, the process of the present invention has a great industrial merit.

The present invention is further explained by examples but the claims of the invention is not limited by the description in the examples.

The parts and percentages in the examples are shown by weight unless otherwise indicated.

EXAMPLE 1

An acrylonitrile copolymer consisting of 91 parts of acrylonitrile, 9 parts of methyl acrylate and 0.5 part of sodium methallyl sulfonate was dissolved in an aqueous solution of sodium rhodanide to prepare spinning solutions, of which the polymer concentrations and solvent concentrations are shown in Table 1. Thereafter, the thus-obtained spinning solutions were extruded through circular spinneret orifices into low temperature coagulation baths of various concentrations of sodium rhodanide while varying the linear velocity ratio of a free extrusion, jet stretch ratio, stretching ratio before drying and relaxing heat treatment condition, to form acrylic fibers of 3 denier single filaments. The anti-pilling and level dyeing qualities of the acrylic fibers under testing are shown in Table 1 as flexing abrasion resistance and dyeing speed with cationic dye, respectively.

Table 1

| Exp. No. | Spinning solution | | Coagulation bath | | Jet stretch ratio | Stretch ratio of swollen gel fiber | Temp. of relaxing heat treatment (°C) |
|---|---|---|---|---|---|---|---|
| | Polymer conc. (%) | NaSCN conc. (%) | NaSCN conc. (%) | L.V.R.F.E. (*) | | | |
| 1 | 17 | 50 | 22 | 0.40 | 1.50 | — | — |
| 2 | 11 | 44 | 22 | 1.15 | 0.39 | — | — |
| 3 | 13 | 46 | 23 | 1.90 | 1.26 | 11.0 | 130 |
| 4 | 11 | 44 | 12 | 0.35 | 0.39 | 10.0 | 125 |
| 5 | 17 | 50 | 25 | 1.10 | 8.17 | 2.0 | — |
| 6 | 11 | 44 | 23 | 1.90 | 1.26 | 9.0 | No relaxation |
| 7 | 11 | 44 | 23 | 1.90 | 1.59 | 6.0 | 110 |
| 8 | 17 | 50 | 26 | 1.50 | 2.38 | 4.5 | 120 |
| 9 | 17 | 50 | 26 | 1.50 | 2.30 | 4.5 | 130 |
| 10 | 17 | 50 | 25 | 1.10 | 2.25 | 4.5 | 140 |
| 11 | 15 | 48 | 25 | 2.60 | 3.05 | 3.0 | 100 |
| 12 | 17 | 50 | 25 | 1.50 | 2.20 | 4.5 | 105 |
| 13 | 15 | 48 | 24 | 1.85 | 1.50 | 7.0 | 115 |
| 14 | 11 | 44 | 22 | 1.15 | 1.96 | 6.0 | 127 |

| Exp. No. | Heating medium | Shrinking ratio of fiber after relaxing heat treatment (%) | Flexing abrasion resistance | Dyeing speed | Remarks |
|---|---|---|---|---|---|

Table 1-continued

| | | | | | |
|---|---|---|---|---|---|
| 1 | — | — | — | — | Spinning was impossible on account of frequent filament breaking and winding around the rollers. |
| 2 | — | — | — | — | Continuous spinning was impossible on account of sagging of swollen gel fiber in the coagulation bath. |
| 3 | Wet heat | 22.2 | 288 | 51.2 | |
| 4 | Wet heat | 18.8 | 120 | 62.4 | |
| 5 | — | — | — | — | Spinning was impossible on account of frequent filament breaking. |
| 6 | — | 0 | 62 | 22.5 | Spinnability of the obtained fibers was poor. |
| 7 | Wet heat | 6.1 | 39 | 32.0 | |
| 8 | Hot air | 0.5 | 24 | 24.1 | |
| 9 | Hot air | 2.5 | 25 | 24.6 | |
| 10 | Hot air | 3.6 | 14 | 25.4 | |
| 11 | Wet heat | 2.3 | 22 | 26.2 | |
| 12 | Wet heat | 4.7 | 30 | 29.0 | |
| 13 | Wet heat | 10.5 | 29 | 37.3 | |
| 14 | Wet heat | 19.2 | 112 | 65.6 | |

*(L.V.R.F.E. = the linear velocity ratio of a free extrusion)

Among the abovementioned experiments, Experiment Nos. 7 to 13 which satisfy the requirements of the present invention were able to continue stable operation throughout the steps of extrusion, stretching, drying and relaxing heat treatment as well as the steps of spinning and weaving, without causing troubles of fiber damage, filament breaking, etc. Note: The flexing abrasion resistance and dyeing speed of the acrylic fibers under testing mentioned in Table 1 were measured according to the following procedures:

1. FLEXING ABRASION RESISTANCE

Two single filaments are crossed with each other such that the angle at the crossing point becomes 60°. The crossed single filaments are moved to rub with each other at the rate of 95 times per minute with the length of the rubbed parts maintained at 10 mm. The rubbing numbers required for filament breaking under rubbing load condition of 0.4 $g/d^{3/4}$ are measured on 20 filaments to obtain the average. The flexing abrasion resistance is shown by this average rubbing number, which is taken as the standard of evaluating the anti-pilling quality of the acrylic fiber under testing.

In order to improve the anti-pilling quality of the acrylic fiber under testing, the flexing abrasion resistance is desirably reduced as small as possible so far as the operation efficiency in the post-processing steps such as spinning, weaving, etc. is not lowered. When the fiber is given a flexing abrasion resistance less than 100 times, preferably less than 80 times, the anti-pilling quality is remarkably improved.

For example, when the acrylic fibers of Experiment Nos. 3, 4 and from 7 through 14 were spun and knitted under the same condition and the thus-obtained knitted fabrics were measured for the anti-pilling quality on an I.C.I. Pilling Tester, remarkable generation of pills (pill grade: class 1 to class 2) was observed in Exp. Nos. 3, 4 and 14 which were out of the range of the constitutional requirements of the present invention, while Exp. Nos. from 7 through 13 which satisfied the constitutional requirements of the present invention did not substantially produced pills (pill grade: class 4 to class 5).

2. DYEING SPEED

An acrylic fiber sample is immersed in a dyeing bath consisting of 4% o.w.f. (on the weight of dry fiber) of Sumi Acryl Orange 3R, a cationic dye, and 3% o.w.f. of acetic acid at a bath ratio of 1 : 100, and dyed at 90°C for 60 minutes. The absorbance (−log T) at 470 mμ of the residual dye solution after dyeing is measured, and the dyeing speed is calculated from the following formula:

$$\text{Dyeing speed} = \frac{\text{Absorbance before dyeing} - \text{Absorbance after dyeing}}{\text{Absorbance before dyeing}}$$

In the dyeing treatment of acrylic fibers by the known rapid dyeing procedure, when the dyeing speed is from about 20 to 40 for fibers having circular cross section and from about 25 to 45 for fibers having flat cross section, it is certified that an improved level dyeability is imparted to the sample fiber. From the results of measurement shown in Table 1, it will be understood that the sample fibers of Exp. Nos. 3, 4, 6 and 14 which deviate from the constitutional requirements of the present invention cause uneven dyeing frequently and a great amount of retarders is necessary to reduce the dyeing speed. On the contrary, each sample fiber of Exp. Nos. from 7 through 13 represents a very good dyeability. This fact substantiates the critical meaning of the constitutional requirements of the present invention.

EXAMPLE 2

The same spinning solutions as in Example 1 were extruded through rectangular spinneret orifices by the wet spinning process, and acrylic fibers of 3 denier single filaments were produced under the same conditions as in Example 1. The spinning conditions, flexing abrasion resistance and dyeing speed are shown in Table 2.

Table 2

| Exp. No. | Spinning solution Polymer conc. (%) | Spinning solution NaSCN conc. (%) | Coagulation bath NaSCN conc. (%) | Coagulation bath L.V.R.F.E. (*) | Jet stretch ratio | Stretch ratio of swollen gel fiber | Temp. of relaxing heat treatment (°C) |
|---|---|---|---|---|---|---|---|
| 15 | 11 | 44 | 18 | 0.45 | 1.18 | — | — |
| 16 | 15 | 48 | 25 | 2.60 | 0.45 | — | — |
| 17 | 13 | 46 | 24 | 2.90 | 1.34 | 10.5 | 130 |
| 18 | 17 | 50 | 26 | 1.50 | 2.17 | 8.5 | 125 |
| 19 | 15 | 48 | 24 | 1.85 | 4.82 | 2.5 | — |
| 20 | 17 | 50 | 26 | 1.50 | 1.82 | 10.5 | No relaxation |
| 21 | 13 | 46 | 23 | 1.90 | 2.47 | 4.5 | 105 |
| 22 | 13 | 46 | 22 | 1.70 | 3.52 | 6.0 | 135 |
| 23 | 17 | 50 | 25 | 1.10 | 2.30 | 7.0 | 115 |
| 24 | 15 | 48 | 25 | 2.60 | 3.51 | 3.0 | 120 |
| 25 | 11 | 44 | 12 | 0.35 | 0.95 | 13.0 | 125 |
| 26 | 13 | 46 | 24 | 2.90 | 2.20 | 6.0 | 130 |

| Exp. No. | Heating medium | Shrinking ratio of fiber after relaxing heat treatment (%) | Flexing abrasion resistance | Dyeing speed | Remarks |
|---|---|---|---|---|---|
| 15 | — | — | — | — | Spinning was impossible on account of frequent filament breaking and winding around the rollers. |
| 16 | — | — | — | — | Continuous spinning was impossible on account of sagging of swollen gel fiber in the coagulation bath. |
| 17 | Wet heat | 20.5 | 643 | 65.7 | |
| 18 | Wet heat | 18.5 | 544 | 69.3 | |
| 19 | — | — | — | — | Spinning was impossible on account of frequent filament breaking. |
| 20 | — | 0 | 178 | 25.0 | Spinnability of the obtained fibers was poor. |
| 21 | Wet heat | 5.0 | 51 | 35.3 | |
| 22 | Hot air | 3.7 | 53 | 30.6 | |
| 23 | Wet heat | 10.1 | 72 | 42.7 | |
| 24 | Hot air | 0.5 | 43 | 28.5 | |
| 25 | Wet heat | 10.7 | 159 | 64.6 | |
| 26 | Wet heat | 13.3 | 352 | 65.5 | |

*(L.V.R.F.E. = the linear velocity ratio of a free extrusion)

Knitted fabrics produced from the sample fibers were subjected to anti-pilling tests on the I.C.I. Pilling Tester as in Example 1. The fibers of Exp. Nos. 17, 18, 25 and 26 showed no improvement in anti-pilling (pill grade: class 1 to class 2), while the fibers of Exp. Nos. 21, 22, 23 and 24 were certified to have a good anti-pilling quality (pill grade: class 4 to class 5). The sample fiber of Exp. No. 20 generated much fly waste and filament breaking during spinning and the production of spun yarn was impossible.

What we claim is:

1. A process for producing an anti-pilling acrylic fiber which comprises dissolving an acrylonitrile polymer in a rhodanide solvent to prepare a spinning solution, wherein a rhodanide solvent in the spinning solution is 40–70%, subjecting the spinning solution to wet-spinning by extrusion through spinneret orifices into a coagulation bath containing a rhodanide solvent in an amount of 50–70% of that in the spinning solution, while maintaining the linear velocity ratio of free extrusion at 1 or higher, and the jet stretch ratio 1.5 or higher, stretching the formed gel fibers 3–7 times the length in hot water or in a heated steam medium at 80°–120°C, drying the stretched fibers and then subjecting the fibers to a relaxation treatment in a hot air current at a temperature of 150°C or lower or in a wet heat atmosphere at a temperature of 120°C or lower, said jet stretch ratio being the quotient obtained by dividing the takeup speed of the coagulated filaments from the coagulation step by the linear velocity of extrusion of the spinning solution through the spinneret orifices.

2. A process according to claim 1 wherein the fibers are introduced into a second extrusion bath which contains a rhodanide solvent in amounts 20–35% of that in the spinning solution.

3. A process according to claim 1, wherein the rhodanide solvent is selected from the group consisting of sodium rhodanide, potassium rhodanide, ammonium rhodanide, calcium rhodanide and mixtures thereof.

* * * * *